US005333427A

United States Patent [19]

Uhlik

[11] Patent Number: 5,333,427

[45] Date of Patent: Aug. 2, 1994

[54] DECORATIVE UTILITARIAN GLASS BLOCK

[75] Inventor: James M. Uhlik, Wexford, Pa.

[73] Assignee: Anchor Hocking Corporation, Freeport, Ill.

[21] Appl. No.: 970,764

[22] Filed: Nov. 3, 1992

[51] Int. Cl.[5] ..... E04C 1/42

[52] U.S. Cl. ..... 52/306; 52/308; 52/605

[58] Field of Search ..... 52/306, 307, 308, 605; 428/34.4, 312.2, 312.6

[56] References Cited

U.S. PATENT DOCUMENTS

| | | | |
|---|---|---|---|
| 2,167,764 | 8/1939 | Lytle | 52/307 |
| 2,244,489 | 6/1941 | Downes | 52/308 |
| 2,261,011 | 12/1941 | Wiley | 52/307 |
| 2,532,478 | 12/1950 | Bridges | 52/306 |
| 4,852,321 | 8/1989 | Fleming, Jr. et al. | 52/306 |
| 4,959,937 | 10/1990 | Mayer | 52/306 |
| 5,033,246 | 7/1991 | Kline | 52/306 |
| 5,160,566 | 11/1992 | Ashby et al. | 52/306 |

FOREIGN PATENT DOCUMENTS

| | | | |
|---|---|---|---|
| 2024887 | 1/1980 | United Kingdom | 52/605 |

OTHER PUBLICATIONS

"PC Glass Block Products", Pittsburgh Corning Corp. 1988.

*Primary Examiner*—Carl D. Friedman
*Assistant Examiner*—Winnie Yip
*Attorney, Agent, or Firm*—Baker & McKenzie

[57] ABSTRACT

A one piece mold glass block especially adapted for interior use which has an aesthetically pleasing appearance characterized by an enclosing wall, usually rectangular in form, within which a central panel is located at the approximate mid point of the wall. One or both of the exterior of the enclosing walls and the central panel may carry a color coating to give a variety of aesthetically pleasing color effects.

5 Claims, 2 Drawing Sheets

DECORATIVE UTILITARIAN GLASS BLOCK

This invention pertains generally to glass blocks and more specifically to a glass block especially well adapted for interior use which has a pleasing aesthetic appearance as well as excellent functional characteristics.

BACKGROUND OF THE INVENTION

Glass blocks have been known for many years but by and large they have been designed and used in conjunction with exterior construction, or, if used in conjunction with interior construction, generally only structural characteristics have been emphasized, presumably on the basis that the glass block must be capable of both interior and exterior applications, and the most rugged application must be provided for. Typical examples are shown in the Locke Des. U.S. Pat. No. 215,714 which pertains to a pilaster building block, the Fleming et al. Des. U.S. Patent No. 318,129 which pertains to a similar type of block, and the Mayer U.S. Pat. No. 4,959,937 which pertains to a glass block panel or wall construction in which the individual blocks function as bricks. All of these constructions have in common a bulky, boxy building block appearance and are intended primarily, if not solely, for utilitarian purposes; indeed, application of these blocks in environments in which they serve both aesthetic as well as utilitarian purposes are usually negated by their boxy appearance shapes and their universal or near universal characteristic of having a sealed interior space which extends over as large an area and space as possible (without detracting from its structural integrity) so as to have a maximum insulating capacity derived from the enclosed dead air space. With advances in living unit construction in recent years there has arisen a need for a glass block which has both utilitarian structural properties, including a good R factor, and an aesthetically pleasing appearance. In addition, since the glass block is intended to be used in an interior environment, it should also have additional capabilities unique to interior use, such as the ability to accept decaling.

Another reason why current glass blocks have been confined to a largely, if not entirely, utilitarian role is that they do not lend themselves to color hues and thus their aesthetic possibilities are very limited, if not nonexistent. Although it would appear that colors would be capable of being applied to the interior of the enclosing walls in current blocks, it is believed that manufacturing considerations, including the joinder step which would undoubtedly deface any prior applied coating in an irregular manner, preclude the use of color as a practical matter. Hence there is no opportunity to customize glass block colors for purposes of coordinating the glass blocks with decorating schemes.

Further, current glass blocks provide no shelf space for nic-nacs or bric-a-brac.

And further, and very importantly, there is a need for an interior glass block having all of the above characteristics which, in addition, can be molded in one piece. By molding a single piece in a single operation the current expensive and time consuming practice of forming two halves separately and subsequently joining them together in a third process operation would be eliminated.

SUMMARY OF THE INVENTION

The invention is a one piece, unitarily molded glass block having enclosing walls, usually four arranged in the shape of a rectangle, and a central panel which extends throughout the area bounded by, and joining the interior facing surfaces of, the enclosing walls. The central panel is preferably formed with a surface which accepts decals so that the inherent decorative capabilities of the glass block can be enhanced, as by application of decals—nature scenes, etc.—to the central panel, all the while retaining the excellent structural properties of this structural building material, including a substantial R rating.

In addition, the block is so constructed that it provides the consumer, or the professional decorator, with an opportunity to customize colors of the block for the purpose of coordinating with decorating schemes. In this connection the product can be surface colored over its entire exterior surface, or only the edges can be colored to provide a subtle color effect, or only a hint of color. Although current glass blocks can also be colored over their entire exterior, such coloring is always entirely on an exterior projecting surface in which it has maximum exposure to deterioration from abrasion and chipping with consequent unsightliness. By contrast, the exterior edge surfaces of the glass block of this invention, when colored, are in a recessed, protected position so that the possibility of derogation of the integrity of the surface is greatly minimized or eliminated. Even if the surfaces of the panel portion which are exposed to ambient surroundings are colored, the location of such colored surfaces are so recused with respect to the edges of the block that the possibility of surface derogation is greatly reduced as contrasted to current blocks.

The block of the invention, in addition to having all of the foregoing attributes, also is molded in one piece whereby the expensive and time consuming practice of forming two halves separately and joining them in a third process operation is eliminated.

BRIEF DESCRIPTION OF THE DRAWING

The invention is illustrated more or less diagrammatically in the accompanying drawing in which.

DESCRIPTION OF A SPECIFIC EMBODIMENT

Figure 1:
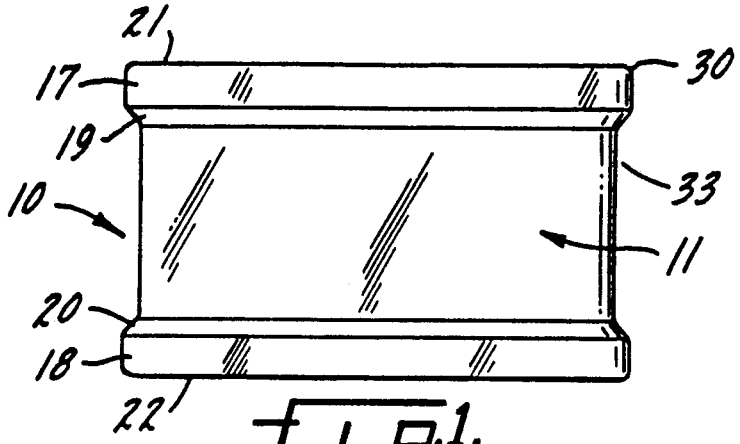
FIG. 1 is a side view of, in this instance, a square-shaped configuration of the structural glass block of this invention.

Like reference numerals will be used to refer to like or similar parts from Figure to Figure in the drawing.

Figure 2:
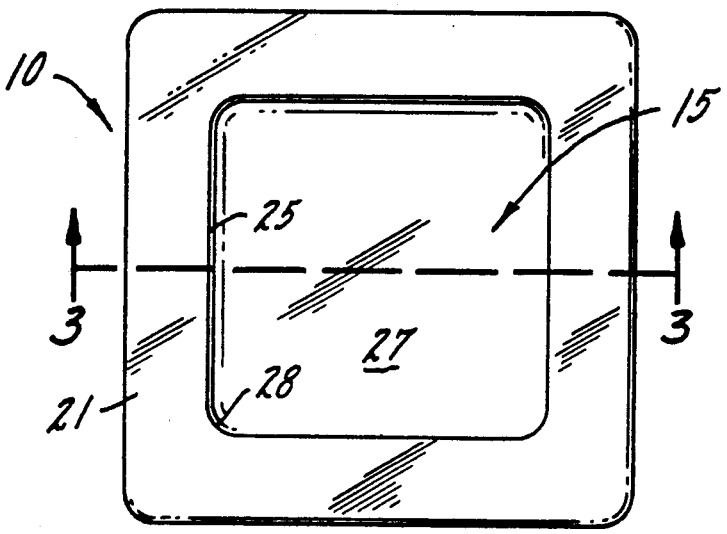
FIG. 2 is a top plan view.
Figure 3:
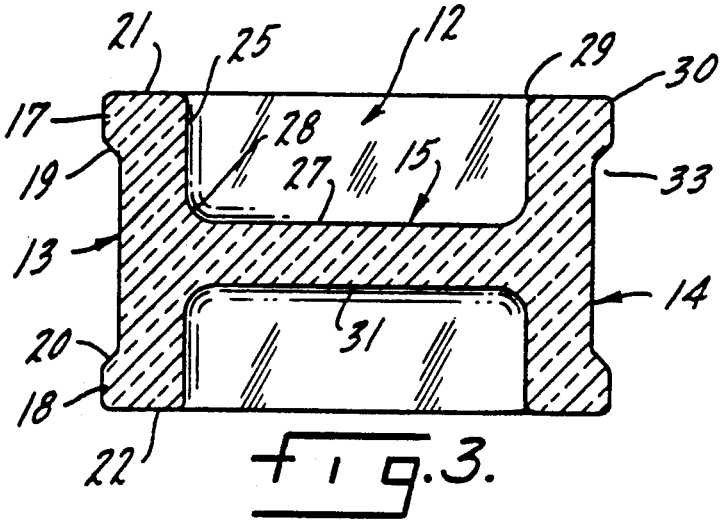
FIG. 3 is a view taken substantially along the line 3—3 of FIG. 2.

Referring first to FIGS. 1-3, the multi-purpose interior structural glass block of this invention is indicated generally at 10. The glass block 10 includes four side or enclosing walls, indicated generally at 11, 12, 13 and 14, which form a closure around a center panel, indicated generally at 15. Sidewall 13, for example, is of substantial thickness, as best seen in FIG. 3, and includes an upper, slightly outwardly extending exterior flange 17 and a lower, slightly outwardly extending exterior flange 18, the underside of flange 17 being smoothly blended into sidewall 13 at 19, and the upper side of lower flange 18 being smoothly blended into sidewall 13 at 20. The upper edge of flange 17 and the upper edge 21 of sidewall 13 has a continuous flat surface in this instance, as does the lower edge of flange 18 and the lower edge 22 of sidewall 13. It will be understood, however, that a continuous flat surface is not essential, and other configurations are possible. It may, for example, be expedient to form a notch at the junction of upper edge 21 and the interior surface 25 of the sidewall for decorative, or decorative and functional, reasons, such as for the reception of grout or other caulking material which may be used when the blocks are stacked one upon the other in a position which is 90° rotated from the position of FIG. 3. The walls and central panel may advantageously have a thickness of on the order of about ⅜" to ½". With thicknesses on the order of those mentioned, an R factor of at least 2.2 is feasible.

The upper surface 27 of central panel 15 is preferably flat and, in this instance, blends gradually at 28 into the interior surface 25 of side wall 13. It will be understood that if, for aesthetic or other reasons, such as a requirement that an insert with right angle corners be received in the chamber formed between walls 11–14 and central panel 15, the gradual blending indicated at 28 could be replaced with a right angle or other configuration. The blended junction is preferred, however, because 90° junctions tend to be stress raisers and more susceptible to failure under loading than are blended junctions. For essentially the same reasons it is preferred that all plane junctions have a blended configuration as exemplified at 29 and 30

In this instance the central panel 15 is shown with flat, parallel upper, 27, and lower, 31, faces. This construction is preferred since a surface which easily receives a decal, or other ornamentation, is presented. It should be understood, however, that the surfaces 27 and 31 may be of any suitable configuration from convex to concave, or even slightly undulating, for example.

It will also be noted that the interior surface 25 and the seven similar interior, but unnumbered, surfaces, form an internal shelf suitable to receive and display nic-nacs and bric-a-brac when the block is installed in a position rotated 90° from the illustrated FIG. 3 position; i.e., see FIG. 2.

Figure 4:
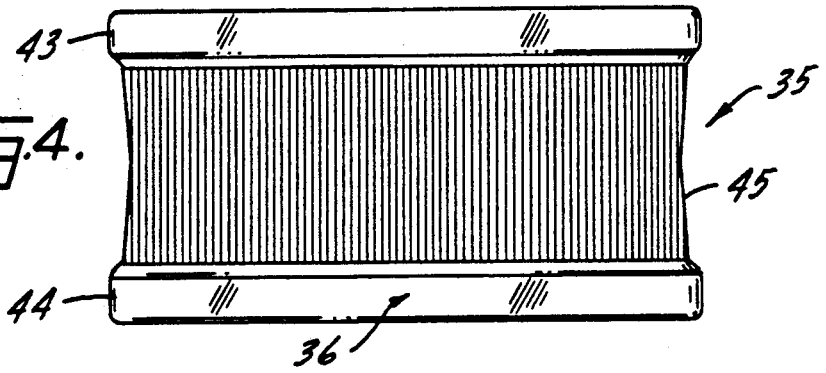
FIG. 4 is a side view of an alternative configuration of the structural glass block of this invention which, in addition, provides colored surfaces so that it becomes a decorative material.
Figure 5:
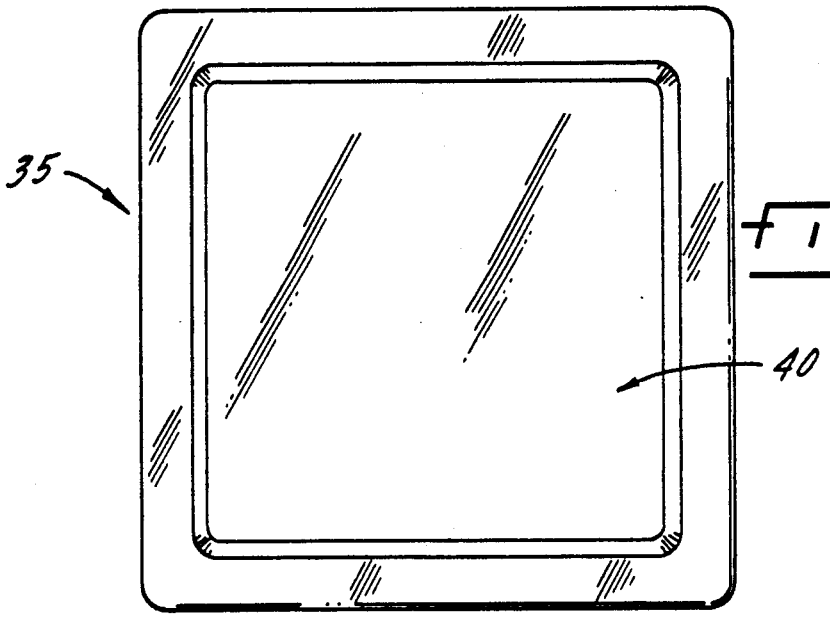
FIG. 5 is a top plan view of the block of FIG. 4.
Figure 6:
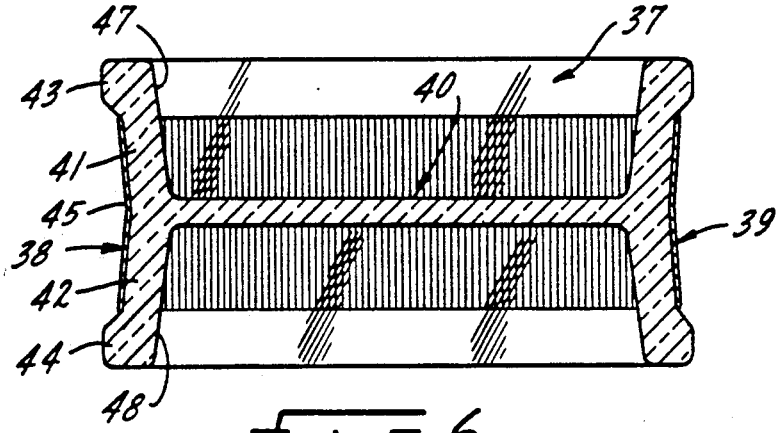
FIG. 6 is a view taken substantially along the line 6—6 of FIG. 5.

Referring now to FIGS. 4–6 an alternative embodiment of this invention is indicated generally at 35. The four side or enclosing walls are indicated at 36, 37, 38 and 39 and they again form a closure around a center panel 40 which, in this instance, is slightly smaller in plane surface area than the center panel 15 of the embodiment of FIGS. 1–3. In this instance each side wall is formed with an inward and outward cant. Referring to FIG. 6, the upper portion 41 of closure wall 38 is canted inward toward its mid-point, and the lower portion 42 is also canted inward toward the mid-point. The two slanted surfaces which are located between upper flange 43 and lower flange 44 have coated thereon a layer 45 of paint or other suitable coating which lends a color effect to the block.

The upper surface 47 and lower surface closure wall 38 are, in this instance also coated with paint or another suitable coating which adheres readily to glass. It will be understood that one or the other or both of said surfaces may be coated depending on the aesthetic effect desired. For example, two different colors, one on the inside and one on the outside, may impart different visual impressions to the eye when viewed from different angles.

From a consideration of the Figures it will be noted that the glass block, while retaining all of the above described desirable functional and aesthetic characteristics, is well adapted to be molded as a single piece in a single operation so that a finished product is produced in one forming operation as contrasted, for example, to three forming and joining operations which must be performed to produce a typical glass block having an internal, sealed chamber. It will be understood that the glass block of this invention is capable of being used in either a horizontal, as illustrated, position to form a generally horizontal area, or in a vertical, stacked position to form a vertical structure such as an interior dividing wall or a defined space in a solid wall. If used in the vertical position, the space 33 formed between upper and lower flanges 17 and 18 co-act to form a channel for the reception of grout or other caulking material which, after application, secures adjacent glass blocks one to the other to form a unitary, multi-unit structure.

The illustrated configuration is rectangular and, specifically, square. It will be appreciated, however, that the invention is not limited to a rectangular configuration. The peripheral shape may, for example, be triangular, hexagonal, or diamond shaped. It is preferred, however, that the shape is such that when three or more such blocks are secured to one another about their periphery, a solid structure is formed.

Although a specific embodiment of the invention has been illustrated and described, it will be apparent that the foregoing description is exemplary only. Accordingly, the scope of the invention is defined solely by the scope of the hereafter appended claims, when interpreted in light of the relevant prior art, and not by the foregoing exemplary description.

I claim:

1. A glass block, said glass block having a one-piece construction, said glass block being homogeneous in composition, said glass block comprising only a continuous central panel, the two surfaces of the central panel being generally parallel to one another; and a wall peripherally enclosing the central panel, the central panel and the enclosing wall being disposed substantially perpendicularly to one another, said central panel being located at the midportion of the enclosing wall, said enclosing wall having an interior surface extending inwardly substantially perpendicularly to opposite sides of said central panel, the interior surface of said enclosing wall disposed around the central panel forming a shelf on both said sides of the central panel, whereby said shelf is accessible by hand from both said sides of the central panel.

2. The glass block of claim 1 further characterized in that the enclosing wall has a substantially uniform thickness.

3. The glass block of claim 2 further characterized in that the central panel has a substantially uniform thickness.

4. The glass block of claim 1 further characterized in that upper and lower edges of the enclosing wall have a flange which extends outwardly peripherally around the wall to thereby form a concave depression in the exterior surface of the wall about its periphery.

5. The glass block of claim 1 further characterized in that at least one of said interior and an exterior exposed surfaces of the enclosing wall has a color coating which is dissimilar to the color of the block to thereby provide an aesthetically different color effect.

* * * * *